United States Patent [19]

Marchais et al.

[11] Patent Number: 4,558,550

[45] Date of Patent: Dec. 17, 1985

[54] INSULATING AND FLUIDTIGHT ROOF COVERING

[75] Inventors: Jean Marchais, Rennes; Michel Netter, Paris, both of France

[73] Assignee: SMAC Acieroid, Paris, France

[21] Appl. No.: 527,364

[22] Filed: Aug. 29, 1983

[30] Foreign Application Priority Data

Sep. 7, 1982 [FR] France ..... 82 15184

[51] Int. Cl.[4] ..... E04C 1/00

[52] U.S. Cl. ..... 52/309.7; 52/309.8; 52/408; 52/452; 52/741

[58] Field of Search ..... 52/309.7, 309.8, 408, 52/741, 452, 454, 336, 600

[56] References Cited

U.S. PATENT DOCUMENTS

| | | | |
|---|---|---|---|
| 3,289,371 | 12/1966 | Pearson et al. | 52/741 X |
| 3,960,999 | 6/1976 | Massie | 52/309.7 X |
| 4,064,663 | 12/1977 | Moss . | |
| 4,206,267 | 6/1980 | Jungbluth . | |
| 4,253,288 | 3/1981 | Chun | 52/454 |

FOREIGN PATENT DOCUMENTS

| | | |
|---|---|---|
| 2613157 | 6/1977 | Fed. Rep. of Germany . |
| 3004615 | 8/1981 | Fed. Rep. of Germany . |
| 269730 | 10/1950 | Switzerland . |

*Primary Examiner*—Carl D. Friedman
*Assistant Examiner*—Creighton Smith
*Attorney, Agent, or Firm*—Wenderoth, Lind & Ponack

[57] ABSTRACT

The covering is constructed on the site and adheres to a corrugated support 1 and to spaced-apart projections 2. It comprises a reinforcing element of metal or of a glass cloth 4, 6 having meshes which are small enough to retain a foaming product which is still in the liquid state but sufficiently rigid (for example ribbed) so as to be planar and have great strength. The reinforcing element is embedded in the foaming material in the course of the solidification of the latter and imparts thereto a planar outer surface. Air pockets are formed between the corrugation roots 10 and the solidified and reinforced foaming product. This reinforcing element may include two successive layers, namely a layer 4 having small meshes and a layer 6 having large meshes, the latter providing the desired strength.

21 Claims, 4 Drawing Figures

INSULATING AND FLUIDTIGHT ROOF COVERING

Fluidtightness and insulation are properties which are increasingly desired in the construction of roofing, and in particular roofing of industrial buildings. Unfortunately, these buildings are very often covered by corrugated sheets, and in particular by asbestos-cement sheets, so that the maintenance of the roof, and even its mounting, or the mounting of an insulating covering, create problems of safety owing either to the fragility of the sheets or to the difficulty with which the personnel may move about on a corrugated surface.

An object of the present invention is to overcome these drawbacks and to provide a roof covering which has sufficient strength to support the personnel constructing or maintaining the roof and a planar surface irrespective of the support on which it is placed.

The invention consequently provides a roof covering which comprises a sheet of foam material which is flat and has a substantially constant thickness in which there is embedded a reinforcing and stiffening reinforcement having small meshes and adhering to a support along spaced-apart lines.

Depending on the building for which the covering is intended, the support may be constituted by corrugated sheets which have already been placed in position on the roofing, the sheet of foam material adhering to the crests of the corrugations of these sheets, or may be fixed directly on the purlins or other elements of the roofing.

In any case, the covering permits a circulation without danger of the personnel maintaining or constructing the roof covering, the reinforcement ensuring both a planar outer surface and a sufficient strength.

According to one embodiment, the reinforcement comprises two layers: a lower layer having fine meshes for retaining the foam material and for stiffening the sheet, and an upper layer having large meshes providing the strength of the assembly.

Another object of the invention is to provide a covering method which comprises placing a flat and taut reinforcement having relatively small meshes on a support comprising projections which are spaced apart from each other and parallel to each other, placing on said reinforcement a liquid foaming product which solidifies almost instantaneously and adheres to the support after having "wetted" the lower side of the reinforcement and swells around said reinforcement and forms a planar sheet. One or more additional layers may be if desired deposited on the first layer.

In this way, there is obtained a fluidtight and insulating covering which may be constructed and maintained in complete safety and which may just as well be formed on a building in course of construction as adapted to an existing building, in particular for converting a corrugated roofing into a roofing having a planar surface.

The following description of one embodiment, which is given merely by way of an example and shown in the accompanying drawings, will bring out the advantages and features of the invention.

Figure 1:
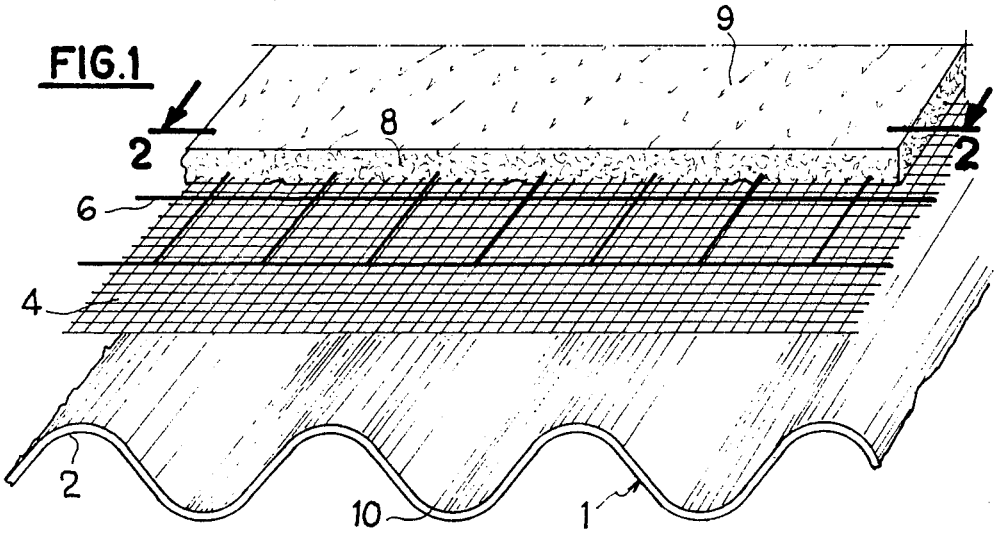
FIG. 1 is a perspective view, with a part cut away, of a portion of a roof covering according to the invention.

As shown in FIG. 1, the roof covering of the invention comprises a support structure in the form of corrugated sheets 1 which are fixed in the conventional manner to the purlins, the fixing of which has not been shown in order to avoid complicating the drawing. Thus this support structure in the form of corrugated sheets defines lines of projecting support surfaces in the form of crests 2 of the sheets with hollows between said support surfaces. Placed on the crests 2 of these corrugated sheets is a reinforcing layer 4 which is formed, for example, by a lattice, a netting, expanded metal, or even a glass cloth. This layer has relatively small meshes, for example square meshes having a 6 mm side dimension, and it is held taut so as to be exactly planar.

Placed on top of the layer 4 is a second layer 6 having large meshes, for example square meshes having a 10 cm side dimension. This second layer is constituted, for example, by sheets of welded lattice, expanded metal, a perforated sheet, a netting, which may be or may not be ribbed, a net of plastics or other elements having great strength.

The two layers 4 and 6 are embedded in foam material 8, which adheres to the crests 2 of the corrugated sheet 1, and constitute a reinforcement for this material. The foaming product is for example polyurethane, polycarbonate, polyurea, having good qualities of adherence to the support 1 and capable of very rapidly solidifying around the layers 4 and 6 and providing a really planar outer surface 9.

Figure 2:
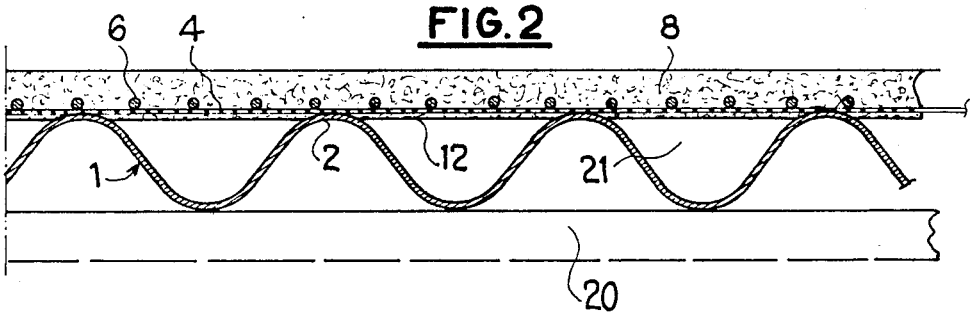
FIG. 2 is a vertical sectional view taken on line 2—2 of FIG. 1.

This covering according to the invention is moreover formed on the site. After the fixing of the corrugated sheets 1 to the purlins 20, the fine mesh layer 4 is first placed on the crests 2 of the sheet 1 and rendered taut so as to form an exactly planar surface, then the second layer 6 is placed on the first layer, and the foaming product, in the liquid state, is deposited on the two layers. This product solidifies almost instantaneously, and in fact within 2 or 3 seconds, so that it is solidified before having had the time to reach the roots 10 of the corrugations of the corrugated sheet 1, and forms only below the layer 4 a thin layer 12 (FIG. 2) which closely adheres to the tops 2 of the crests of the sheet 1.

It will be understood that the small meshes of the layer 4 are sufficiently large to allow a part of the liquid to pass therethrough before the solidification thereof occurs but are however sufficiently small to limit this penetration of the liquid to the thin layer 12 and prevent the liquid from flowing freely in the direction of the corrugation roots 10. These meshes must have between a 5 and 20 mm side dimension. A space or an air pocket 21 is then left in each corrugation root between the sheet 1 and the reinforced foam 8 of the covering which improves the coefficient of insulation.

The dimensions of the meshes of the second layer 6 and the material of this second layer are so chosen as to impart to the latter great strength so that it is capable of supporting relatively high loads and in particular personnel constructing or maintaining the roof.

The covering obtained in this way provides not only a fluidtight and insulating roof for the roofing but also safety of the personnel who construct or maintain the roof.

Figure 3:
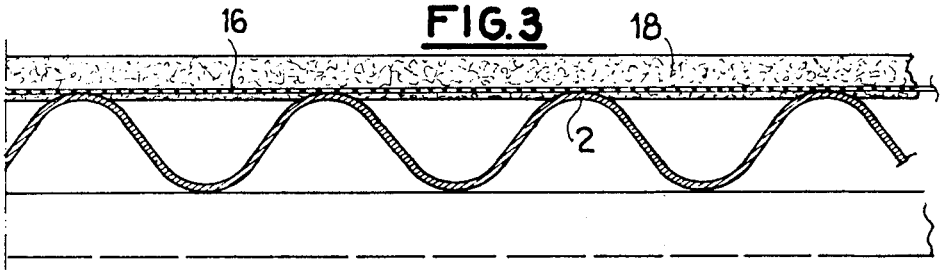
FIG. 3 is a view similar to FIG. 2 of a modification of the invention.

According to a modification of the invention, shown in FIG. 3, the two layers 4 and 6 are merged into one layer 16 which bears on all of the corrugation crests of the sheet 1 and is, as the layers 4 and 6, embedded in a foam product 18 of which it constitutes the reinforcement. The layer 16 ensures the stiffening of the covering and the retention of the liquid product while it imparts to the whole considerable strength which enables it to support heavy loads while remaining planar. This reinforcement 16 may, for example, be of a ribbed expanded metal or a glass cloth which permits constructing the covering at a lower cost.

In a particularly advantageous embodiment of the invention, there is employed a lattice of a glass cloth plastified of high resistance having the following characteristics:

weight: 350 g/sq.m.
strength: 20 kg/cm
mesh: 5×5 sq.mm.
laces: 2 mm and 2.5 mm
coefficient of transparency: 30%

This lattice has rather large meshes so that the foaming liquid passes therethrough and can thus wet the tops of the supports on which the foam will be fixed by adhesion. However, the meshes are small enough so that, when sprayed, only a very small amount of foaming liquid passes therethrough which would be lost for the construction of the covering.

Thus:

1. The loss of foaming product which passes through the lattice is limited to a minimum amount which, in the case of the fibre cement roof, is deposited in the corrugation roots.

2. The foaming product nonetheless passes through the lattice in a sufficient amount so that the whole of the covering thus formed adheres to the crests of the support with no addition of a prior adhesive.

3. The lattice thus coated with the foaming product can, in the course of the swelling, rise into the first layer of foam so as to be located in the heart of the latter and thus participate in the strength of the assembly.

Figure 4:
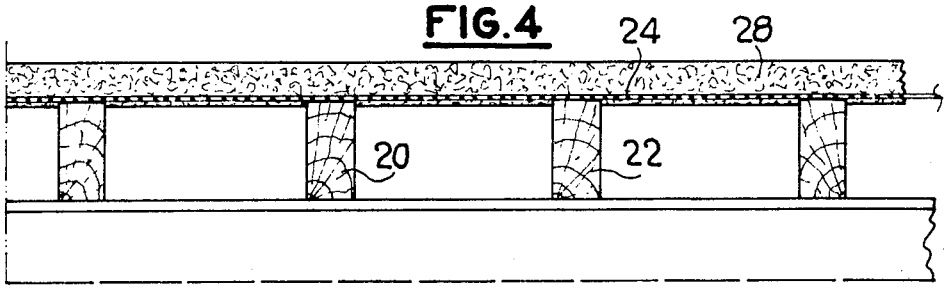
FIG. 4 is a view similar to FIG. 2 of a roof covering placed directly on the purlins of the roofing.

In this embodiment, as in the preceding embodiment, the whole of the sheet 8 provided with the reinforcement constituted by the layers 4 and 6 or by the single layer 16, is sufficiently rigid to rest on the support formed by the corrugated sheet 1 only along the crests 2, i.e. along spaced-apart lines. It is consequently clear that such a sheet of reinforced foam may also be carried by other types of support. For example, as shown in FIG. 4, the support structure comprises spaced-apart purlins 20, 22 of a roofing which define lines of projecting support surfaces and spaces or hollows between the support surfaces. The sheet of reinforced foam is here fixed directly on the successive purlins 20, 22 of the roofing and constitute the roof in itself. A reinforcement 24, comprising one or more reinforcing layers, is then held taut directly on the purlins 20, 22, and embedded in the foam product 20 which solidifies therearound by adhering to the top of each of the purlins 20, 22. Owing to the reinforcement 24, the outer side of the roof is planar and the assembly has sufficient rigidity and provides an effective insulation and fluidtightness.

It will be understood that one or more additional layers of foaming product may be sprayed onto the reinforced foamed sheet 8, 18, 28 if required, so as to provide a suitable thickness of the covering.

In any case, the covering is easy to construct. The sheet of foaming product 8, 18 or 28, is indeed based on planar elements which only need to be fixed locally on their support. This covering is particularly advantageous for the protection of corrugated roofing, and in particular for converting a corrugated roof into a roof having a planar surface. In this way it is possible to benefit from not only the qualities of the covering itself, but also from a reduction in the developed area and therefore in the thermal flux for a given thickness of insulator while improving the exterior appearance.

Further, with a volume of material which is small relative to that usually necessary on corrugated roofs, there is obtained a distinctly improved evenness of thickness, i.e. an improved quality of insulation at a reduced cost.

As soon as the reinforcement is placed in position, and any time thereafter, safety of circulation thereover on the part of personnel is ensured.

Having now described our invention what we claim as new and desire to secure by Letters Patent is:

1. An insulating and fluidtight roof covering for constructing on the site, said covering comprising in combination, a support structure defining spaced-apart lines of projecting support surfaces and hollows between said support surfaces, a substantially flat sheet of foam material having a substantially constant thickness, generally sheet-shaped reinforcing and stiffening means having small meshes embedded in the sheet of foam material, said meshes being of such size as to allow passage therethrough of a minor portion of said foam material toward said support surfaces when said foam material is in a prior liquid state for application on said reinforcing means and support surfaces so that, when the foam material is in a set state after application, a major portion of the foam material is retained by said reinforcing means and said minor portion of the foam material adjacent to said support surfaces has extended through and beyond the meshes of the reinforcing means and into direct contact with said support surfaces, said foam material adhering directly to said support surfaces by its own adhesiveness, said major portion and said minor portion of said foam material constitute a single integral piece of said foam material, and said minor portion of the foam material spans the hollows between adjacent ones of said support surfaces and only slightly penetrates said hollows to an extent depending on the thickness of the foam material on a side of the reinforcing means adjacent to said support surfaces.

2. A covering according to claim 1, wherein the reinforcing element comprises meshes which have a size equivalent to the size of square meshes having a substantially 5 mm side dimension.

3. A covering according to claim 1, wherein the reinforcing means comprise a lower layer having small meshes for retaining the foaming product in the liquid state and an upper layer having larger meshes and sufficient strength to resist the weight of personnel walking over the covering.

4. A covering according to claim 1, wherein the reinforcing means consist of a single layer having said small meshes and constituting a form bottom and also providing strength.

5. A covering according to claim 4, wherein said single layer is of a ribbed expanded metal.

6. A covering according to claim 4, wherein said layer is of a glass cloth.

7. A covering according to claim 3, wherein the lower layer is formed by a metal net.

8. A covering according to claim 3, wherein the lower layer is formed by a glass cloth.

9. A covering according to claim 3, wherein the upper layer is formed by a welded lattice.

10. A covering according to claim 3, wherein the upper layer is formed by an expanded metal.

11. A covering according to claim 3, wherein the upper layer is formed by a perforated sheet.

12. A covering according to claim 3, wherein the upper layer is formed by a netting.

13. A covering according to claim 3, wherein the upper layer is formed by a grating.

14. A covering according to claim 3, wherein the upper layer is formed by a plastic net.

15. A covering according to claim 1, wherein said support structure is formed by corrugated roof sheets, the foam material adhering to corrugation crests which define said support surfaces.

16. A covering according to claim 1, wherein said support structure is formed by a series of spaced-apart roofing purlins having outer surfaces defining said support surfaces.

17. A method for covering roofing comprising placing a flat and taut reinforcing element having relatively small meshes on a fixed support comprising projections which projections are spaced apart and substantially parallel to each other and define hollows therebetween, and depositing on said reinforcing element a liquid foaming product which almost instantaneously solidifies by adhering to the projections of the support under the effect of its own adhesiveness after having wetted a lower side of the reinforcing element and swelled around the reinforcing element so as to constitute a substantially planar sheet spanning said hollows and only slightly penetrating said hollows, said meshes having such size as to allow passage therethrough of only a minor portion of said foam material.

18. A method according to claim 17, comprising spraying onto the planar sheet of reinforced foam at least one other layer of foaming product.

19. A covering according to claim 1, wherein said meshes have a size equivalent to the size of square meshes having a side dimension of between 5 mm and 20 mm.

20. A covering according to claim 3, wherein said small meshes have a size equivalent to the size of square meshes having a side dimension of between 5 mm and 20 mm, and said larger meshes have a size equivalent to the size of square meshes having a side dimension of substantially 10 cm.

21. A covering according to claim 1, wherein said reinforcing means has a coefficient of transparency of substantially 30%.

* * * * *